US009994236B2

(12) United States Patent
Louw

(10) Patent No.: US 9,994,236 B2
(45) Date of Patent: Jun. 12, 2018

(54) RAIL TRANSPORT BOGIE AND A RAIL TRANSPORTATION SYSTEM

(71) Applicant: FUTRAN LTD, Wanchai (HK)

(72) Inventor: Andries Auret Louw, Pretoria (ZA)

(73) Assignee: FUTRAN LTD, Wanchai (HK)

( * ) Notice: Subject to any disclaimer, the term of this patent is extended or adjusted under 35 U.S.C. 154(b) by 397 days.

(21) Appl. No.: 14/891,268

(22) PCT Filed: May 16, 2014

(86) PCT No.: PCT/IB2014/061492
§ 371 (c)(1),
(2) Date: Nov. 13, 2015

(87) PCT Pub. No.: WO2014/184780
PCT Pub. Date: Nov. 20, 2014

(65) Prior Publication Data

US 2016/0129921 A1 May 12, 2016

(30) Foreign Application Priority Data

May 16, 2013 (ZA) ..... 2013/03562

(51) Int. Cl.
*B61B 3/00* (2006.01)
*B61B 3/02* (2006.01)

(52) U.S. Cl.
CPC ..... *B61B 3/02* (2013.01)

(58) Field of Classification Search
CPC ..... B61B 3/00; B61B 3/02
(Continued)

(56) References Cited

U.S. PATENT DOCUMENTS 3,929,077 A * 12/1975 Benndahl ..... B61B 5/00 104/288
4,284,010 A * 8/1981 Marshall ..... B60L 13/00 104/171

(Continued)

FOREIGN PATENT DOCUMENTS

CA 2291955 6/2001
DE 9003155 7/1991

(Continued)

OTHER PUBLICATIONS

International Search Report and Written Opinion from International Application No. PCT/IB2014/061492 dated Oct. 3, 2014.

(Continued)

*Primary Examiner* — Jason C Smith
(74) *Attorney, Agent, or Firm* — Dorsey & Whitney LLP

(57) ABSTRACT

Rail transport bogie (1) configured to operate on a track (2) having track surfaces (3,4) on opposite sides thereof and an slot (5) extending along substantially the center of the track (2), the bogie (1) comprising a load-bearing wheel (9) to run on a first (3) of the two track surfaces, a support shaft (11) extending from the load-bearing wheel (9) operatively through the slot (5) in the track (2) and terminating in load support means (8), a first pinch wheel (12) rotatably secured in a forward position (20) in respect of the support shaft (11) and a second pinch wheel (13) rotatably secured in rearward position (21) in respect of the support shaft (11), with both the first (12) and second (13) pinch wheels located between the load-bearing wheel (9) and load support means (8) to run on the second (4) of the two track surfaces, the load-bearing wheel (9) and pinch wheels (12,13) clamping between them the bogie (1) to the opposing track surfaces (3,4), and at least one of the load-bearing wheel (9) and either or both of the pinch wheels (12,13) connected to a motor (10) operatively to be driven thereby to comprise a driven wheel for the bogie (Continued)

(1). Also disclosed are a rail transportation system and a track for a rail transportation system using such a bogie (1).

26 Claims, 8 Drawing Sheets

(58) Field of Classification Search
USPC ..... 104/88.01–88.04, 89, 93, 94, 95
See application file for complete search history.

(56) References Cited

U.S. PATENT DOCUMENTS 4,488,015 A * 12/1984 Geng ..... B60M 7/00 105/150
4,532,385 A * 7/1985 Friske ..... B60L 5/40 104/105
5,020,440 A * 6/1991 Ohara ..... B61B 13/04 104/127
6,688,235 B2 * 2/2004 Rajaram ..... B61B 3/02 104/89
7,441,506 B2 * 10/2008 Bruns ..... B61B 10/04 104/118
8,156,874 B2 * 4/2012 Hansen ..... A61G 7/1042 105/153
2012/0125221 A1 * 5/2012 Gustaffson ..... B61B 13/04 104/89
2016/0129921 A1 * 5/2016 Louw ..... B61B 3/02 104/88.01

FOREIGN PATENT DOCUMENTS

EP 0488475 6/1992
EP 2082941 7/2009
WO WO 95/20704 8/1995

OTHER PUBLICATIONS

International Preliminary Report on Patentability from International Application No. PCT/IB2014/061492 dated Sep. 7, 2015.

* cited by examiner

RAIL TRANSPORT BOGIE AND A RAIL TRANSPORTATION SYSTEM

FIELD OF THE INVENTION

This invention relates to a rail transport bogie and a rail transportation system.

BACKGROUND TO THE INVENTION

Conventional transportation systems utilise several means to move goods and people. These include conventional rail transport systems that are typically powered by one or more locomotives that pull, or push, interconnected railcars. Locomotives typically have to be heavy enough to get sufficient traction on the rail track in order for it to accelerate the weight of the entire train from standstill to a specified speed, pull it up inclines and to decelerate the train from speed down to standstill again.

This is problematic due to the high relative weight of the locomotives to the overall weight of the load. To get traction, a train has to be heavy or extra motors have to be added to each and every rail cart being pulled by the locomotive or locomotives. This increases the cost and complexity of the train. The heavier the train itself has to be to get traction, the less efficient it is because weight is being carried around unnecessarily. For example, a train with freight cars dedicated to the movement of ore from a mine to a processing plant will typically be laden in one direction and empty in the opposite direction. The unnecessary weight is now being carried twice the distance.

Of course it would be easier to obtain better traction if trains used wheels made from a material with a higher friction coefficient with respect to steel rails, for example rubber or polymers. However, such wheels will not have the durability required for rail transport. Such wheels would wear much faster than steel wheels and may fail under compression of the loads they have to support (in circumstances where steel wheels do not fail). Trains often have to transport heavy loads over very long distances and it will be extremely disruptive if a train has to have a wheel changed along the way. Considering that a train cannot simply pull over to change a wheel like a truck can do, it becomes clear why trains are forced to use wheels made from highly durable and reliable material, such as steel.

When moving people or goods in high volumes using conventional public transport systems and bulk good transport systems such as busses, trucks, and trains three major problems are experienced:

1. Conventional systems include batch-based systems. This means a batch of people or goods are moved between two points. This is less efficient than a continuous movement system, because people and goods have to wait before they can be grouped into a batch that is moved, and if the batch is completed then the people or goods have to wait for the next batch to be filled before they can be moved. Typically, for example with people transport, in peak times there is not enough capacity to move the batches fast enough, resulting in long waiting periods. In off-peak times, bulk transport system operators typically downscale the number of batches per time unit thus reducing the active capacity of the system, also resulting in long waiting periods.
2. Conventional systems also include movement in accordance with a predetermined schedule, and not on demand. This results in batches often not being filled and the vehicles often having to transit well below their optimum load capacity, and on other times for there to be a higher demand than the number of batches scheduled can accommodate, again leading to sub-optimum movement.
3. Conventional systems moving in accordance to a schedule often do not run from a starting point straight to a destination point, but rather from a starting point to and end point while stopping at various points, such as stations, in between. This increases travel time and also results in sub-optimum utilization of transport capacity.

Conventional logic dictates that the solution to these problems is to move larger volumes of people and goods together in order to improve economies of scale, and then to optimise the scheduling of the vehicles so that the movement of empty or half full vehicles are minimised, and then to limit the number of stops the vehicle makes along the scheduled route so that overall time is saved where possible. A train operator hitching more railcars during peak hours to the same locomotive provides evidence of this. It is also evidenced, in trucks carrying greater numbers of containers each. In trains handling raw materials such as ore, it is not uncommon to observe trains having a length of several hundreds of meters, even in excess of a kilometer, and for that ore transportation track to then only have a single starting point and a single destination point. This is also replicated in, for example, the road trains of the Australian outback.

A problem with this approach is that due to the sheer bulk the drive unit for such high capacity transport unit has to be increased. This comes at an increased cost and strain on the equipment. Due to the sheer weight and inertia of the system, it takes longer to accelerate and decelerate, which actually increases the actual travel time of the unit. In addition, if the unit suffers a malfunction then a larger volume of people or bulk material is delayed whilst the problem is sorted out.

It is proposed by the applicant that people and bulk goods may be transported much more efficiently in small transportation units, and for the transportation system as a whole to have the ability to allow individual transportation units to move independently, or in small groups, from any station along the transportation network to any other station without having to stop at stations in between this departing station and the specific destination station. This is particularly true if the movements are provided on demand rather than according to a predetermined schedule, and when the units are moved in an automated manner as opposed to requiring a driver.

It is believed, as an example, that it would be highly efficient for commuters to be transported in small transportation units catering for as few as 6 people or less at a time, from any position on a pre-established transportation network, for example a grid of intersecting tracks, to any other selected position on this network on demand when those people want to be moved from the one position to the other, without them having to abide by a schedule or having to waste transit time by having to stop at other positions along the network in between their departing and destination positions.

In such an instance it is recognized that it would be necessary for the individual transportation units to be able to, in traveling from one location to another, switch safely and at reasonable speed from one track to another in the grid.

The same should apply to the transport of goods between positions on the grid.

OBJECT OF THE INVENTION

It is an object of the invention to provide a rail transport bogie, a rail transport system and a track for such a bogie and transport system, which at least partly overcome the above-mentioned problems.

SUMMARY OF THE INVENTION

In accordance with this invention there is provided a rail transport bogie configured to operate on a track having track surfaces on opposite sides thereof and a slot through the track extending along substantially the centre of the track, the bogie comprising a load-bearing wheel to run on a first of the two track surfaces, a support shaft extending from the load-bearing wheel operatively through the slot in the track and terminating in load support means, a first pinch wheel rotatably secured in a forward position in respect of the support shaft and a second pinch wheel rotatably secured in rearward position in respect of the support shaft, with both the first and second pinch wheels located between the load-bearing wheel and load support means to run on the second of the two track surfaces, the load-bearing wheel and pinch wheels clamping between them the bogie to the opposing track surfaces, and at least one of the load-bearing wheel and either or both of the pinch wheels connected to a motor operatively to be driven thereby to comprise a driven wheel for the bogie.

There is further provided for movement of the bogie in a forward or rearward direction to be effected by forward or rearward driving of the driven wheel.

There is further provided for the bogie to be configured, upon acceleration thereof as a result of rotation of the driven wheel, for inertia of a load operatively secured to the load support means to pivot the bogie on the axis of the load-bearing wheel to force the pinch wheel located in the then rearward position relative to the direction of movement of the bogie against the second of the track surfaces, operatively increasing the clamping force between the load-bearing wheel and the rearward pinch wheel to increase friction between the load-bearing wheel and first of the two track surfaces to assist with acceleration of the bogie and the load secured to it.

There is also provided for the bogie to be configured, upon deceleration thereof as a result of braking of any of the wheels of the bogie, for inertia of a load operatively secured to the load support means to pivot the bogie on the axis of the load-bearing wheel to force the pinch wheel located in the then forward position relative to the direction of movement of the bogie against the second of the track surfaces, operatively increasing the clamping force between the load-bearing wheel and the forward pinch wheel to increase friction between the load-bearing wheel and first of the two track surfaces to assist with deceleration of the bogie and load secured to it, either to reduce its speed or bring it to rest.

There is further provided for the bogie to be configured, upon reaching a steady speed at which the force required to maintain the forward speed of the bogie is lower than the force required to accelerate the bogie from rest, for the rearward pinch wheel to be forced with a lesser force, or not to be forced at all, against the second of the track surfaces and respectively for the clamping force to be commensurately lower compared to when the bogie is accelerated from rest or for the clamping force to be zero, operatively allowing the bogie to move with a lower clamping force between the load-bearing wheel and the then rearward pinch wheel at steady speed than at acceleration of the bogie.

There is further provided for the driven wheel to comprise a set of two axially aligned, preferably axially connected, driven wheels, with the driven wheels configured such that they both run on either the first or the second of the two track surfaces on opposing sides of the slot in the track.

There is still further provided for each pinch wheel to comprise a set of two axially aligned, preferably axially connected, pinch wheels, with each pinch wheel set configured such that in each set the two pinch wheels run on the second of the two track surfaces on opposing sides of the slot in the track.

There is further provided for a pinch wheel bracket to be secured to the load support shaft and for the bracket to extend to two opposing ends, a first end to a forward position in respect of the support shaft and second end to a rearward position in respect of the support shaft, and for the first pinch wheel to be rotatably secured to the first end, and for the second pinch wheel to be rotatably secured to the second end of the pinch wheel bracket.

There is still further provided for the load-bearing wheel to comprise the driven wheel.

There is further provided for the ratio of the distance between the axis of the rearward pinch wheel and the attachment of the pinch wheel bracket to the load support shaft to the distance between the axis of the attachment of the pinch wheel bracket and the load support means to be variable depending upon how much friction is required between the driven wheels and the two track surfaces to create the optimum amount of traction that is required for any specific set of circumstances, the ratio preferably being between 1:2 and 1:5, and most preferably to be about 1:3 where the bogie is predominantly operated horizontally.

There is further provided for the ratio of the distance between the axis of the rearward pinch wheel and the attachment of the pinch wheel bracket to the load support shaft to the distance between the attachment of the pinch wheel bracket and the load support means to be at least 1:5, where the bogie is operated, at least on part of a track, at steep angles.

There is still further provided for the load-bearing wheel and the pinch wheels to have resiliently compressible running surfaces, preferably comprised of rubber or plastics material, alternatively for the load-bearing wheel and the pinch wheels to have substantially incompressible running surfaces, preferably comprised of metal, further preferably steel.

There is further provided for the motor to comprise a linear motor or a rotary motor, and preferably for a linear motor reaction plate or reaction plates forming part of the linear motor to be secured to the load support shaft, preferably above the pinch wheel bracket, and alternatively for the rotary motor to be secured to the load support shaft, preferably below the pinch wheels.

According to a further feature of the invention there is provided for the bogie to include guidance means operable at each track intersection to move the bogie laterally across the track towards one side of the track or another, depending on which track the bogie is to follow leading from the track intersection, the guidance means comprising at least one guide wheel being movable between a neutral position and a guiding position, with the guide wheel configured in its guiding position to interact with a guide member that extends along a track leading from a track intersection to cause the bogie to follow such track, and the guide wheel configured to not interact with any guide member when it is located in its neutral position.

According to a yet further feature of the invention there is provided for the bogie to include guidance means operable at each track intersection to move the bogie laterally across the track towards one side of the track or another, depending on which track the bogie is to follow leading from the track intersection, the guidance means comprising at least two guide wheels located on opposing sides of a longitudinal axis of the bogie and being movable between a neutral position and a guiding position, with each guide wheel configured in its guiding position to interact with a guide member on its side of the longitudinal axis of the bogie that extends along a track leading from a track intersection to cause the bogie to follow such track, and the guide wheels configured to not interact with a guide member when they are located in their neutral positions.

There is further provided for the two guide wheels to be connected and configured such that both guide wheels cannot simultaneously be in their respective guiding positions.

There is also provided for the bogie to include an electrical contact configured complimentary to an electrical rail associated with the track operatively to electrically connect the bogie with the rail, preferably for the electrical contact to extend from above and to the side of the driven wheel, and further preferably for the contact to be electrically connected and configured to charge the battery or power the motor.

There is still further provided for the bogie to include drive control means secured to the load support shaft proximate the motor, preferably on an opposing side of the load support shaft relative to the motor.

There is further provided for the motor and the driven wheel to be rotatably secured by means of a drive belt or drive shaft, preferably a chain extending around sprockets on each of a motor drive shaft and the axis of the driven wheel, alternatively when a chain is not best suited for the bogie to include a secondary drive shaft that is connected from the motor drive shaft to the axis of the driven wheel using a coupling, preferably a differential coupling.

In an alternative configuration there is provided for the motor to be connected to the driven wheel via a sprocket secured to a secondary axis proximate the axis of the driven wheel, with the secondary axis and the axis of the driven wheel being rotatably secured to each other by meshed gears having a predetermined gear ratio.

There is further provided for the load support means to comprise a load bearing secured to the end of the load support shaft, and preferably for the load to be securable to the load bearing enabling the load to be suspended from the bogie, pulled behind the bogie or pushed in front of the bogie.

There is still further provided for the bogie to include a frame secured proximate the load support shaft end, for the frame to extend to two opposing ends, a first end to a forward position in respect of the support shaft and second end to a rearward position in respect of the support shaft, and for each end to extend into an arm directed towards the pinch wheel on its side of the load support shaft, with each arm carrying a battery.

There is further provided for each arm to terminate in at least one directional control wheel operatively running on the sides of the slot in the track, and preferably for each arm to terminate in a set of spaced apart directional control wheels operatively running on opposing sides of the slot between the opposing track surfaces, the running surfaces of the directional control wheels spaced apart by a distance complimentary to the width of the slot.

According to a further feature of the invention there is provided a rail transportation system comprising a network of tracks, a plurality of bogies as defined above each of which has a driven wheel arranged to run on and be supported by the track and which are capable of supporting, pulling or pushing a load secured to the bogie, each bogie being driven along the track and including guidance means which allows it to switch from a track leading to a track intersection to a preselected track leaving the track intersection without any load-bearing wheel of the bogie being unsupported by the track.

There is further provided for at least some of the tracks to meet one another at track intersections, for the system to include guidance means which allows each bogie to switch from a track leading to a track intersection to a preselected track leaving the track intersection without any driven wheel of the bogie being unsupported by the track.

There is further provided for the track intersection to include no moving parts to enable bogie switching.

There is further provided for the guidance means to comprise a rib that extends along each track leading from a track intersection, the rib being shaped and configured to direct a raised guide wheel on its side of the bogie to its operative outside.

There is still further provided for the track to comprise an elongate set of races spaced apart by an elongate slot with the set of races kept in spatial relation to each other by means of a frame extending from the sides of the races, the load support shaft of the bogie operatively extending through the elongate slot.

The invention also provides for the track to include an electrical rail extending at least for part of the length of the track above the first of the two track surfaces complimentary shaped and configured to the electrical contact of the bogie to allow the bogie electrical contact operatively to contact the rail.

According to a yet further feature of the invention there is provided a track for the rail transportation system defined above, the track being modular, the modules including straight sections and curved sections, and for each module to include a set of races spaced apart by an elongate slot through the track operatively allowing the load support shaft of a bogie to extend through the slot, with the set of races kept in spatial relation to each other by means of a frame extending across the track, preferably from the sides of the races, with each race being provided with a wear resistant lining removably secured to its top, bottom and side facing the slot.

There is further provided for the frame to include a brace proximate the end of each module with each brace having a set of spaced apart legs each of which is secured to a side of the track, with covers secured between the braces to enclose at least part of the track, and with braces of adjoining modules substantially sealing against each other.

There is still further provided for each end brace of a module to include a flange securable to a complimentary flange of an end brace of an adjoining module, operatively allowing modules to be secured end to end.

The invention further provided for the race of the track to be comprised of an elongate beam, preferably a hollow beam, preferably a hollow steel beam.

These and other features of the invention are described in more detail below.

BRIEF DESCRIPTION OF THE DRAWINGS

A preferred embodiment of a bogie, a rail transportation system using such a bogie, and a track for such a rail transportation system according to the invention is described by way of example only and with reference to the accompanying drawings in which.

DETAILED DESCRIPTION OF THE INVENTION

Figure 1:
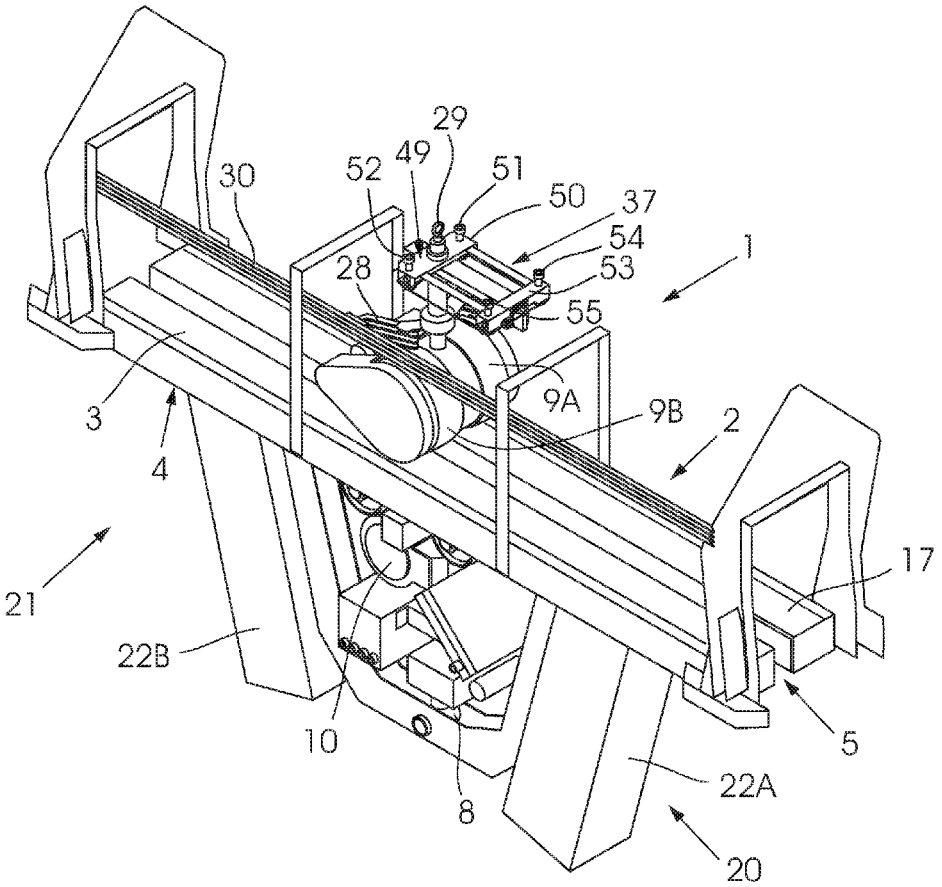
FIG. 1 is an isometric view first embodiment of a bogie according to the invention shown on a track according to the invention.
Figure 2:
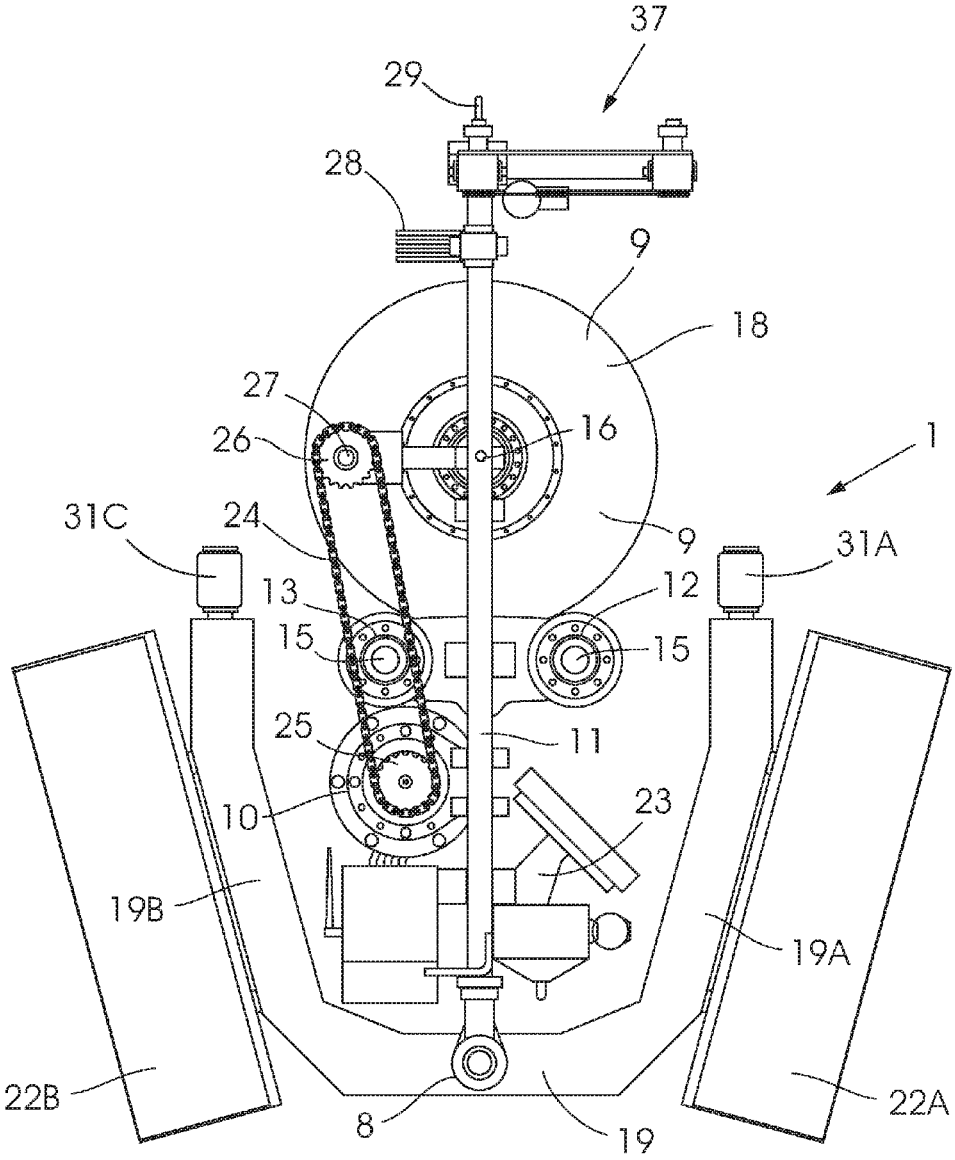
FIG. 2 is a cross sectional view of the bogie of FIG. 1.
Figure 3:
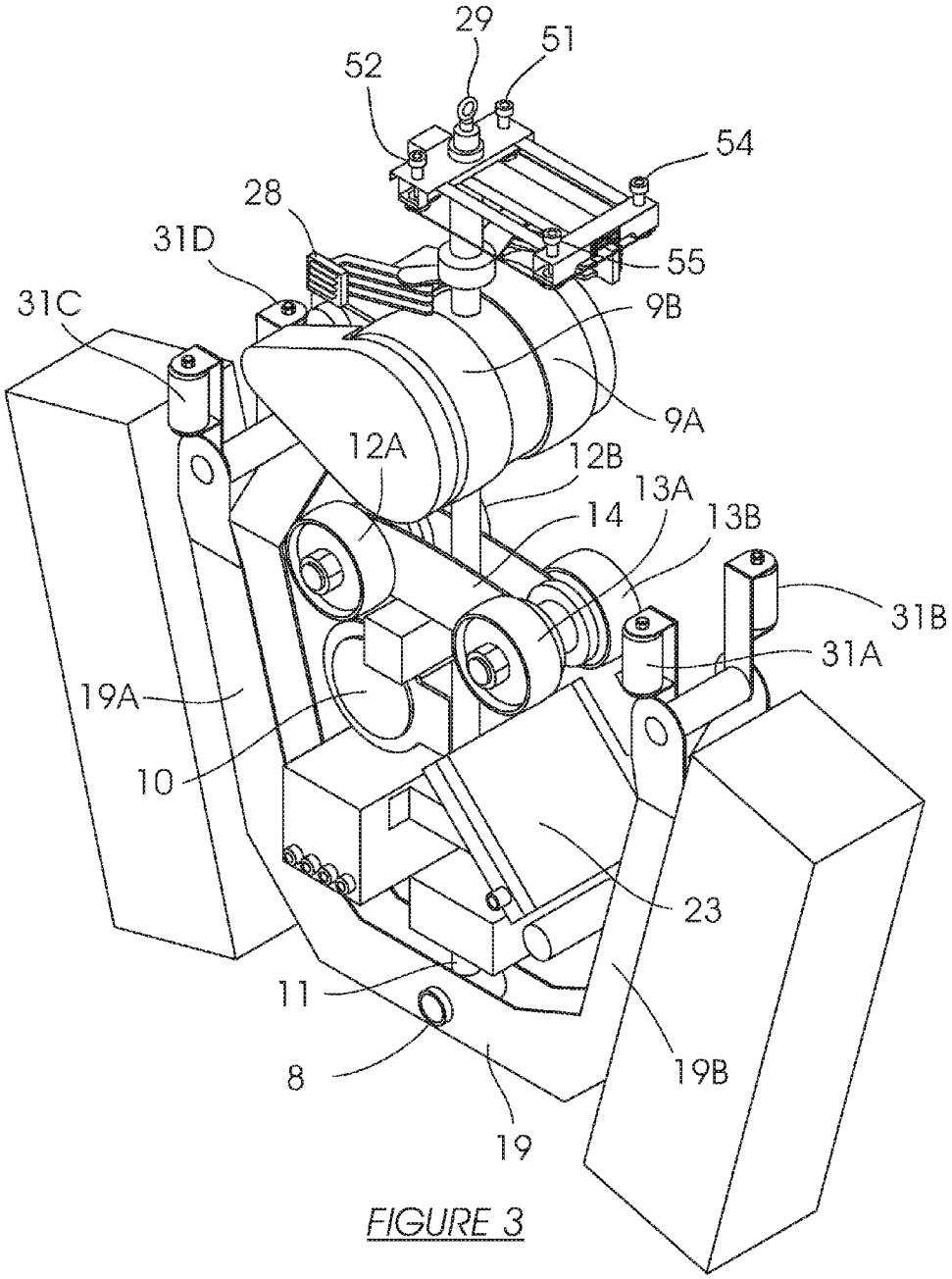
FIG. 3 is a side elevation of the bogie of FIG. 1.

A bogie (1) according to the invention is, shown in detail in FIGS. 1 to 3, is configured to operate on a track (2) having track surfaces (3, 4) on opposite sides thereof and a slot (5) extending along substantially the centre of the track (2). The track (2) is provided with track intersections (6) at which guidance means (37) associated with the bogie (1) is operable to guide the bogie (1) onto a selected track (2A, 2B) leading from the track intersection (6).

The bogie (1) is designed to carry a load (7) and be driven and guided on its own. Several of the bogies may also be connected to work in unison and carry greater loads.

Each bogie (1) is however configured to be able to operate independently from other bogies and to be driven along the track (2). It therefore needs only to carry its own weight and that of its load (7). The bogie (1) also includes load attachment means (8) that allows different types of loads to be carried by the bogie (1), allowing the bogie (1) to perform multiple transport functions. This includes allowing the bogie to transport a load by it being suspended form the bogie (1), it being pulled by the bogie (1) and it being pushed by the bogie (1).

To achieve this, the bogie (1) comprises a load-bearing driven wheel (9) connected to a motor (10) operatively to be driven thereby on a first (3) of the two track surfaces. This first track surface (3) is the upper track surface in this embodiment. A load support shaft (11) extends from the driven wheel (10) operatively through the slot (5) in the track (2) and terminates in the load support means (8).

The bogie (1) further includes a first pinch wheel (12) rotatably secured in a forward position (20) in respect of the support shaft (11) and a second pinch wheel (13) rotatably secured in rearward position (21) in respect of the support shaft (11). Both the first (12) and second (13) pinch wheels are located between the driven wheel (9) and the load support means (8) to run on the second (4) of the two track surfaces. This second track surface (4) is the bottom track surface in this embodiment.

Between them the driven wheel (9) and pinch wheels (12, 13) clamp the bogie (1) to the opposing track surfaces (3, 4), and thus to the track (2).

The driven wheel (9) comprises a set of two axially aligned driven wheels (9A, 9B) configured such that they both run on the first (3) of the two track surfaces on opposing sides of the slot (5) in the track (2). The two driven wheels (9A, 9B) are axially connected.

Similarly, each pinch wheel (12, 13) comprises a set of two axially aligned and connected pinch wheels (12A, 12B; and 13A, 13B), to form two pinch wheel sets (12, 13). Each pinch wheel set (12, 13) is configured such that in each set the two pinch wheels run on the second (4) of the two track surfaces on opposing sides of the slot (5) in the track (5), in other words the right pinch wheels (12A, 13A) run on the right side of the slot (5) and the left pinch wheels (12B, 13B) run on the left side of the slot (5), on the second (4) of the track surfaces.

The bogie (1) includes on its load support shaft (11) a pinch wheel bracket (14), with a forward end and rearward end, extending aligned with the longitudinal axis of the bogie (1)—thus they are operatively aligned with the slot (5) in the track (2).

The pinch wheels sets (12, 13) are rotatably secured (15) to the respective ends of the pinch wheel bracket (14).

The two pinch wheel sets (12, 13) are orientated parallel to the track (2), at least when the bogie (1) is at rest as will be explained in more detail below.

The pinch wheel bracket (14) is secured just below the bottom (4) of the track (2).

The ratio of the distance between the axis (15) of the rear pinch wheel set (12) and the attachment of the pinch wheel bracket (14) to the load support shaft (11) to the distance between the attachment of the pinch wheel bracket (14) and the load support means (8) is variable depending upon how much friction is required between the driven wheels (9) and the first (3) of the two track surfaces to create the optimum amount of traction that is required for any specific set of circumstances.

More specifically, the ratio is determined by taking into consideration the friction coefficient between the running surface of the (18) driven wheel (9) and the track races (17) of the track (2) on which the bogie (1) is intended for use, specifically whether it is predominantly horizontal or whether it also includes some steep angles (incline or decline).

If the bogie (1) is predominantly operated horizontally, then the ratio is selected to be between 1:2 and 1:5.

If the bogie (1) is operated, at least on part of a track, at steep angles then the ratio is selected to be about 1:5.

In this embodiment the bogie (1) is intended to be used on a track (2) which includes steep angles, and the ratio is thus predetermined to be about 1:5.

It should be further noted that the specific ratio is also dependant on the choice of material for the running surface (18) of the driven wheel (9). If it is made of a resiliently compressible material such as rubber or plastics material as compared to a substantially incompressible material such as metal, more specifically steel, then the ratio may be reduced.

As will be further apparent from viewing FIGS. 1 to 3, the bogie (1) includes a frame (19) secured proximate the end of the load support shaft (11). The frame (19) extends to two opposing ends (19A, 19B), both of which are aligned with the longitudinal axis of the bogie (1) and thus aligned with the slot (5) in the track (2). A first end (19A) of the frame (19) is thus directed to a forward position (20) in respect of the bogie (1) and its load support shaft (11) and second end (19B) to the rearward position (21) in respect of the load support shaft (11). Each end (19A, 19B) of the frame (19) is directed towards the pinch wheel (12, 13) on its side (20, 21) of the load support shaft (11).

The frame (19) is configured to carry further equipment associated with the bogie (1). Each arm (19A, 19B) carries a battery (22A, 22B) secured to it. The frame (19) further carries the motor (10) and control equipment (23) associated with the bogie (1). The control equipment (23) includes electronic control for the drive and communications equipment.

The motor (10) may be a linear motor or a rotary motor, and in this embodiment it is a rotary motor (10). The motor (10) and the driven wheel (9) are rotatably secured by means of a drive belt, in this embodiment comprising a drive chain (24), that is rotatably located around sprockets (25, 26) on each of a drive shaft of the motor (10) and a secondary axis (27) proximate the axis (16) of the driven wheel (9). The secondary axis (27) and the axis (16) of the driven wheel (9) are both provided with gears (not shown) that are meshed together which provides an effective predetermined gear ratio between the rotary motor (10) and the driven wheel (9).

The bogie (1) is further provided with an electrical contact (28) extending from its top, as shown in FIGS. 1 to 3. The electrical contact (28) is configured to be in resiliently biased contact with an electrical rail (30) extending along the top of the track (2). The electrical contact (28) is connected to the control system (23) of the bogie (1) and charges the batteries (22A, 22B). The bogie (1) is configured such that the motor (10) is powered from the batteries (22A, 22B) and these are charged by the electrical connection (28, 30). This allows the bogie (1) to continue driving even if there is an interruption in power supply to the track (2) or through sections of the track that may not be electrical powered. This also allows the transport system to operate through remote areas where electrical supply may not be available.

The bogie (1) is also provided with a hoist lug (29) from its operative top, to assist in removing it for maintenance and placing it on the track (2) again.

As will further be apparent from FIGS. 1 to 3 the arms (19A, 19B) terminate in directional control wheels (31A and 31B; 31C and 31D). These directional control wheels (31A and 31B; 31C and 31D) extend above the pinch wheels into the slot (5), where they run on opposite sides of the inside the slot (5). These directional control wheels (31A and 31B; 31C and 31D) prevent sideways movement of the bogie during forward or rearward motion, by guiding the bogie (1) against the inside of the slot (5).

The load support means (8) comprises a load bearing secured to the end of the load support shaft (11), extending through the sides of the frame (19). This allows a load (7) to be suspended from the load support shaft (11) and to remain vertically orientated irrespective of the inclination that the track (2) follows, freely pivoting on the load bearing (8).

In use the bogie (1) may be operated with or without a load (7), and in solo or in-line with one or more other bogies.

When used alone the bogie (7) is, for example, loaded by suspending a load (7) from the load support shaft (8), on the load support bearing (8). This load (7) may comprise a bucket filled with ore, as shown in FIGS. 4 to 7. In this example the bogie (1) is used to move the load of ore (7) between two points, for example from a mine to an ore processing plant.

Figure 4:
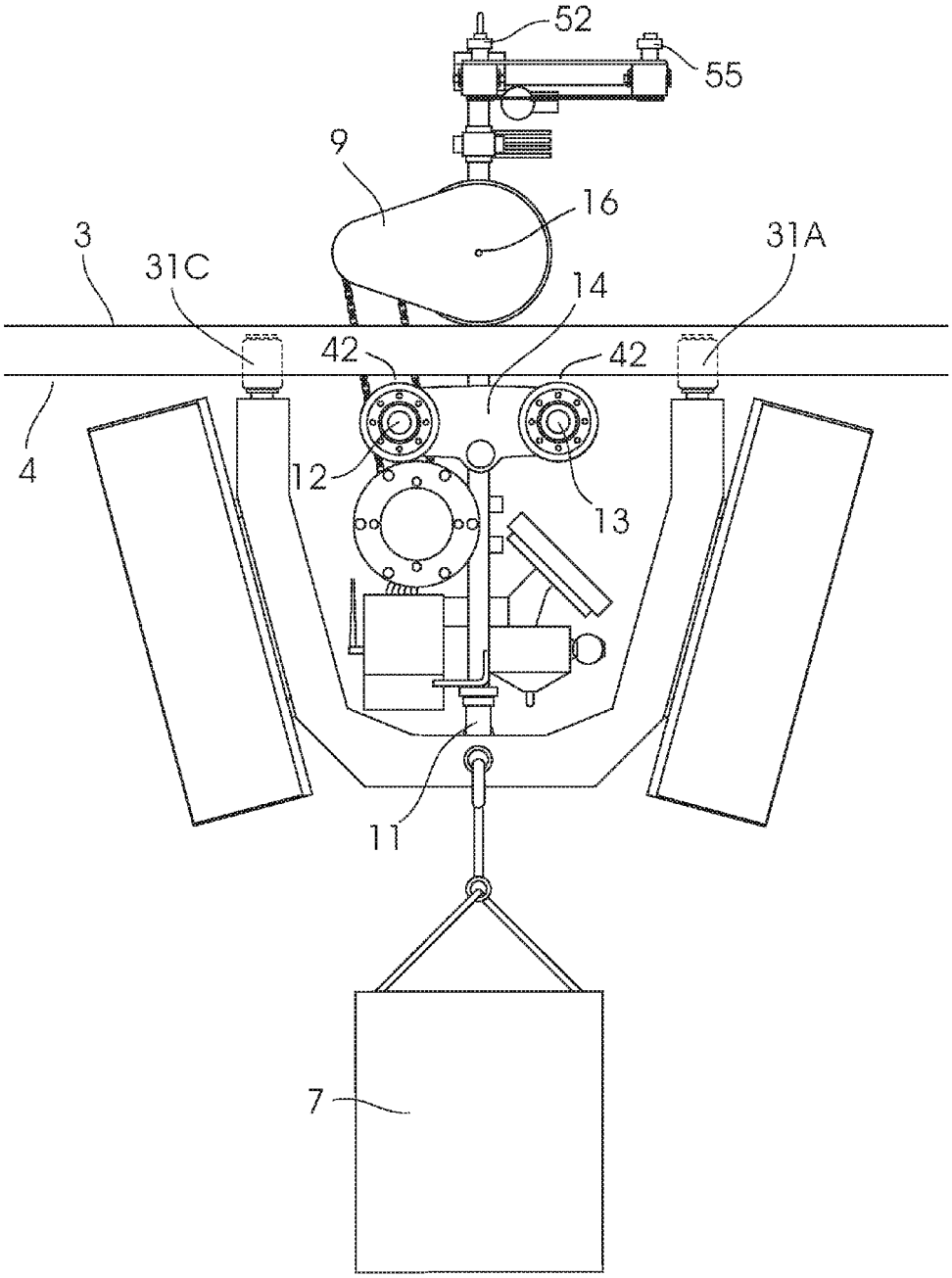
FIG. 4 is a side view of the bogie of FIG. 1 on a track according to the invention with a load suspended from it.

Initially after being loaded, the bogie (1) is at rest and the load (7) is suspended vertically from it. In this position, the pinch wheels (12, 13) are all spaced apart (42) from the bottom of the track, i.e. the second (4) of the track surfaces. This is shown in FIG. 4.

With the bogie (1) loaded it is brought into motion by activation of the motor (10), to drive the driven wheel (9) through the chain (24). With the load (7) initially completely vertically suspended from the bogie (1), the running surface (18) of the driven wheel (9) is forced onto the upper race (17) of the track (2). The static coefficient of friction between the driven wheel running surface (18) and the upper race (17) is sufficient to allow the electric rotary motor (10) to drive the bogie (1) forward, even though the running surface (18) of the driven wheel (9) is steel.

Figure 5:
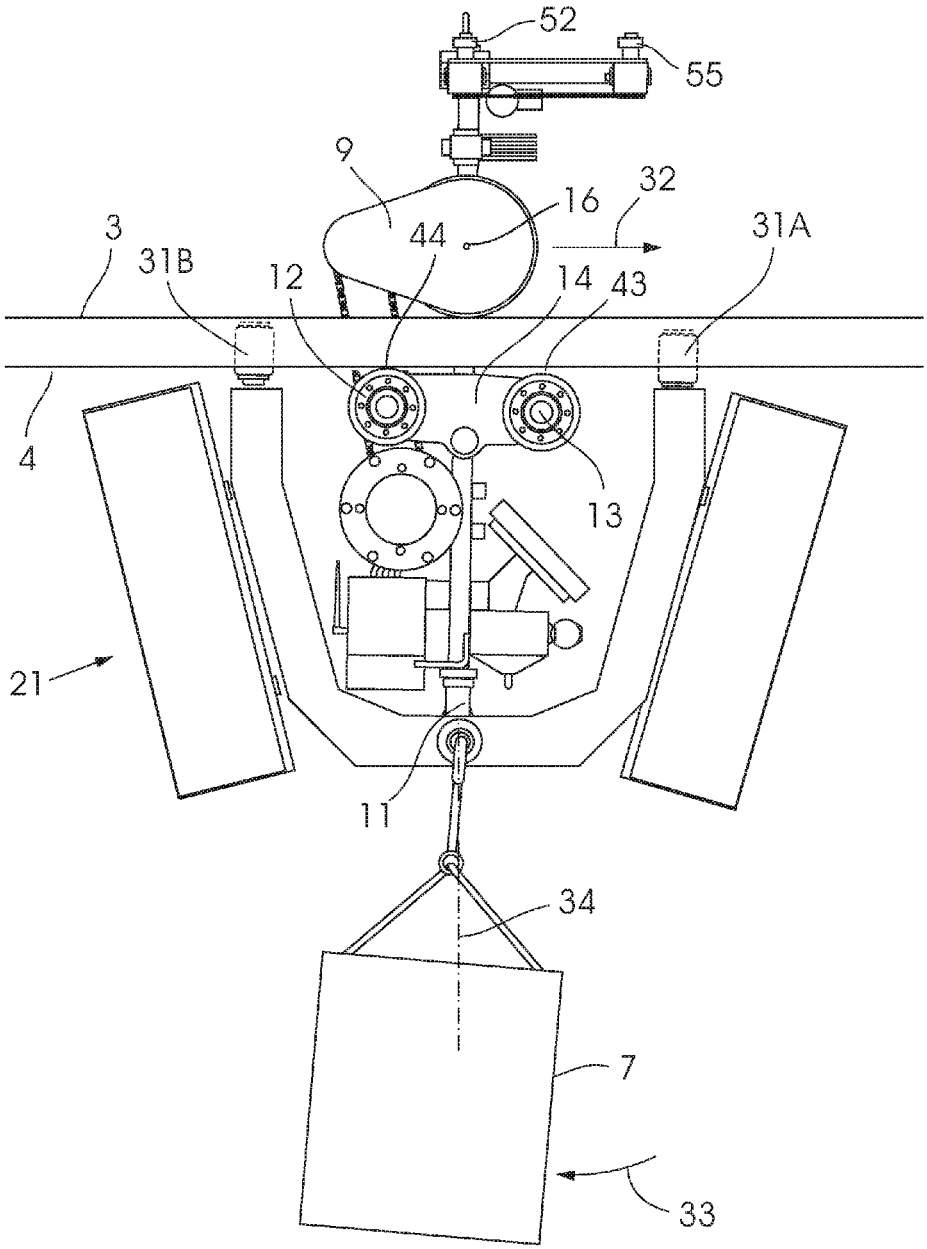
FIG. 5 is a side elevation view of a bogie according to FIG. 1 accelerating from rest.

As shown in FIG. 5, when the bogie (1) moves forward (32), the inertia of the load (7) causes the load (7) to effectively swing (33) behind the longitudinal axis (34) of the load support shaft (11), which at rest on a horizontal track is of course vertical.

This pivots the bogie (1) clockwise in this embodiment around the axis (16) of the driven wheel (9) and forces the then rearward pinch wheel (12) against (44) the second (4) of the two track surfaces, i.e. up against the bottom of the track behind the load support shaft (11). The forward pinch wheel (13) moves slightly further away (43) from the second (4) of the track surfaces. As mentioned above, initially, at rest, the two pinch wheels (12, 13) do not actually touch the bottom (4) of the track, but as soon as the bogie (1) comes into the motion, the inertia of the load (7) forces the rearward pinch wheel (12) into contact (44) with bottom (4) of the track (2).

The rearward rotation of the bogie (1) thus forces the rearward pinch wheel set (12) into contact (44) with the bottom (4) of the track (2). This clamps the bogie (1) to the track (2) and increases the friction between the driven wheel running surfaces (18) and the upper race (17) of the track (2). With increased friction the bogie (1) overcomes any potential slippage on the track (2) and is thus able to pull greater loads.

The greater the load the greater the rearward rotation of the bogie (1) around the axis of the driven wheel (9) and the greater the increase in clamping force. This translates to greater friction and a greater ability to pull a load. The clamping force of the bogie (1) onto the track (2) is thus dependant on the weight of the load (7), with a greater load generating a greater clamping force, which overcomes the greater likelihood of slippage. As will be shown below it is also dependant on the inclination of the track (2).

The clamping force is determined by the ratio of the distance between the axis (15) of the rearward pinch wheel (12) and the attachment of the pinch wheel bracket (14) to the load support shaft (11) to the distance between the attachment of the pinch wheel bracket (14) and the load support means (8). As mentioned above, for a bogie (1) that is operated, at least on part of a track (2), with steep angles such as in the present embodiment, the ratio is set at 1:5.

The force with which the bogie (1) is clamped to the track also depends on the weight of its load (7), the incline or decline at which it is moving and whether it is accelerating, decelerating or driving at a steady speed.

As mentioned above, upon acceleration of the bogie (1), the rearward pinch wheels (12) are forced against (44) the second (4) of the track surfaces, operatively increasing the clamping force between the driven wheel (9) and the rearward pinch wheel (12) to increase friction between the driven wheel running surface (18) and the race (17) of the first (3) of the two track surfaces to assist with acceleration of the bogie (1) and the load (7) secured to it.

Upon reaching a steady speed the force required to maintain the forward speed of the bogie (1) is lower than the force required to accelerate the bogie (1) from rest. The rearward pinch wheel set (12) is then forced with a lesser force, or not at all, against the second (3) of the track surfaces compared to when the bogie (1) is accelerated from rest. The clamping force is thus commensurately lower compared to when the bogie (1) is accelerated from rest, and may on a horizontal section of the track (2) be zero. This will be similar to the situation shown in FIG. 4 where the bogie is at rest. This allows the bogie (1) to continue moving with a lower clamping force between the driven wheel (9) and the then rearward pinch wheel (13) at steady speed than during acceleration or a zero clamping force. This improves the energy efficiency of the bogie (1), since it uses less electrical power to be driven forward at steady speed than required for acceleration.

Figure 6:
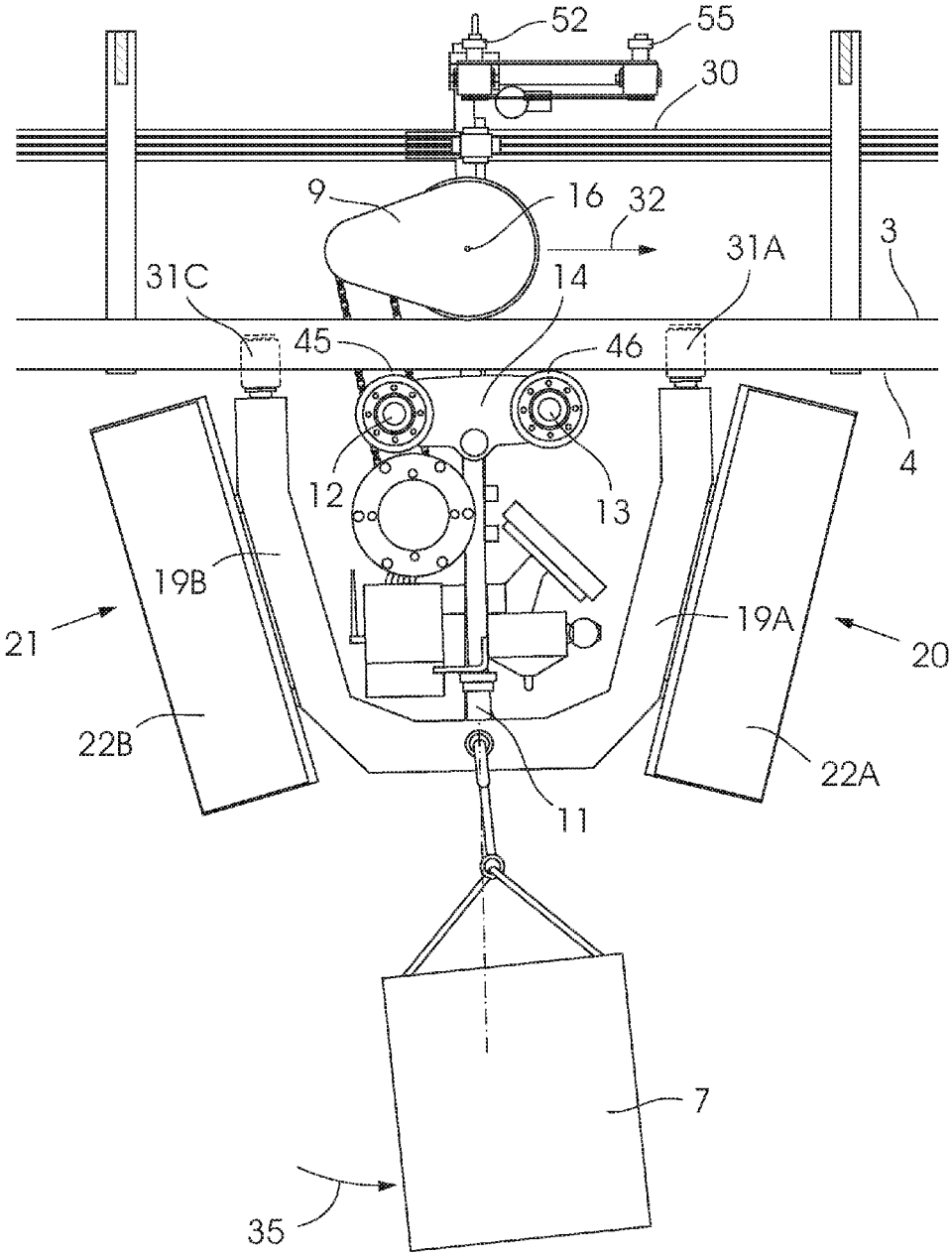
FIG. 6 is a side elevation view of a bogie according to FIG. 1 decelerating.

As shown in FIG. 6, upon deceleration of the bogie (1) as a result of braking of the driven wheel (9)—which reduces the forward (32) speed of the bogie (1)—the inertia (35) of the load (7) pivots the bogie (1) anti-clockwise in this embodiment, which is the reverse of what happens under acceleration.

This pivoting of the bogie (1) forces the pinch wheel (13) located in the then forward position (20) relative to the direction of movement (32) of the bogie (1) against (46) the second (4) of the track surfaces. This increases the clamping force between the driven wheel (9) and the forward pinch wheel set (13) to increase friction between the driven wheel running surface (18) and race (17) of the first (3) of the two track surfaces to assist with deceleration of the bogie (1) and load (7) secured to it, either to reduce its speed or bring it to rest. The rearward pinch wheel (12) moves slightly further away (45) from the second (4) of the track surfaces.

The forward (13) and rearward (12) pinch wheels thus both act to increase the clamping force of the bogie (1) onto the track (2) during acceleration, steady driving and deceleration.

The bogie (1) can also be turned around and driven in the opposite direction, loaded or unloaded, and the pinch wheels (12, 13) will perform in the same manner, with the then rearward pinch wheel set (13) being forced against the second (4) of the track surfaces upon acceleration and traveling at steady speed, and the leading pinch wheel doing the same upon deceleration.

Considering the design of the bogie and the track, it should be evident that the track (2) can be inclined or declined. In fact, the track can be to completely vertical up or down. The limitation here will only be the dimensions of the load (7) secured to the load support shaft (11), it being necessary that the length of the load container is limited to not extend beyond the pinch wheels (12, 13) when the track (2) is at vertical. This is to prevent the load container from contacting the second (4) of the track surfaces.

As will be appreciated, to have the bogie (1) with a load (7) climb or descend a vertical incline or decline it requires sufficient clamping force of the bogie (1) to the track (2). This is achieved by the increased clamping force of the bogie (1) to the track as described above. When the track (2) is at vertical the clamping force for a specific load will be at its greatest. If the load (7) is heavier the clamping force will be greater, and vice versa. Again, the clamping force is provided as much as is required by the bogie (1) to move along the track (2).

Figure 7:
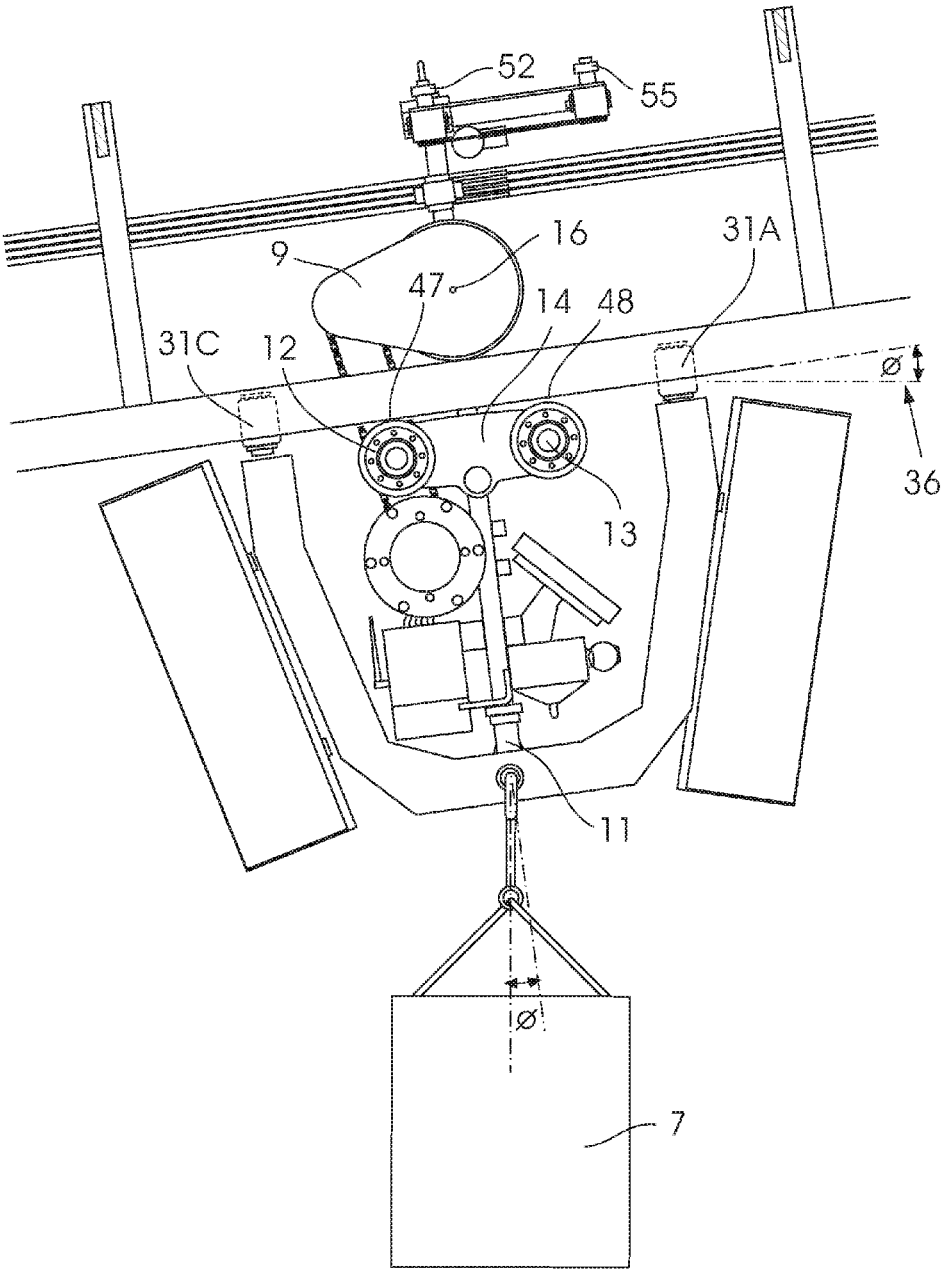
FIG. 7 is a side elevation view of a bogie according to FIG. 1 traveling up an incline.

An example of the bogie (1) driving up an incline is shown in FIG. 7. It can be seen that gravity causes the load (7) to swing by the same angle (θ) to the longitudinal axis of the load support shaft as the angle (θ) of the incline (36). This pivoting of the load (7) causes the bogie (1) to pivot clockwise, in this embodiment, around the axis (16) of the driven wheel (9), which has the same effect of increasing the clamping force between the rearward pinch wheel set (12) as is experienced during acceleration.

The rearward pinch wheel (12) is thus forced against (47) the second of the two track surfaces, and the forward pinch wheel (13) moves slightly further away (48) from the second (4) of the track surfaces.

Similarly, if the bogie (1) travels down an incline (not shown) the load (7) will pivot forward to pivot the bogie, in this embodiment, in an anticlockwise direction with the same effect as is experienced during deceleration.

When the bogie (2) has climbed up or down a vertical section of the track (2) and travels at steady speed and on a level part of the track the clamping force will again reduce to the lower amount required to move the bogie (2) and its load (7) forward, being even zero if the track (2) is complete horizontal. The clamping force therefore dynamically and automatically adjusts depending on track (2) inclination and the weight of the load (7), ensuring that the bogie (1) can continue to move the load (7) on the track (2).

Figure 8:
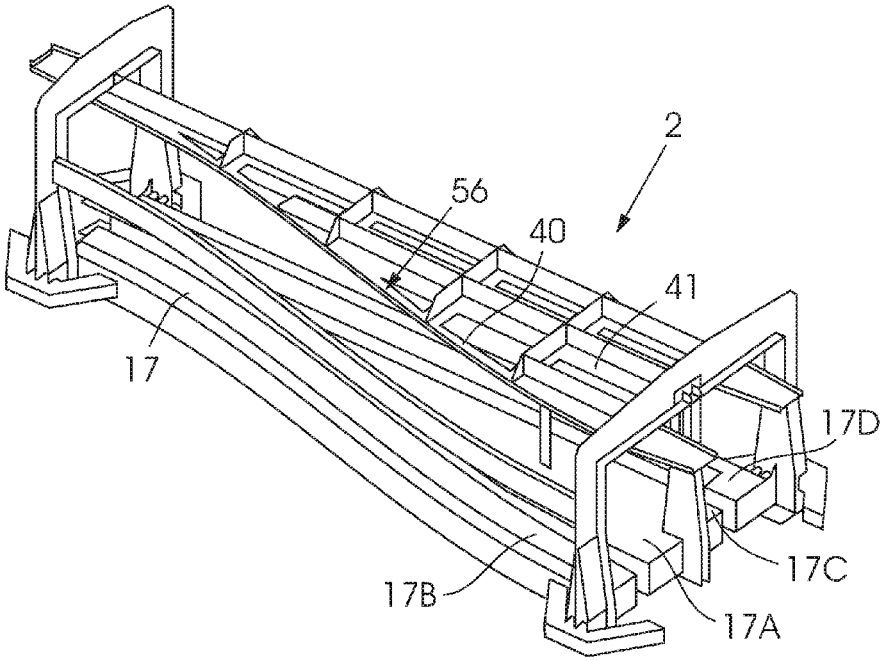
FIG. 8 is an isometric view of an intersection in a track according to the invention.
Figure 9:
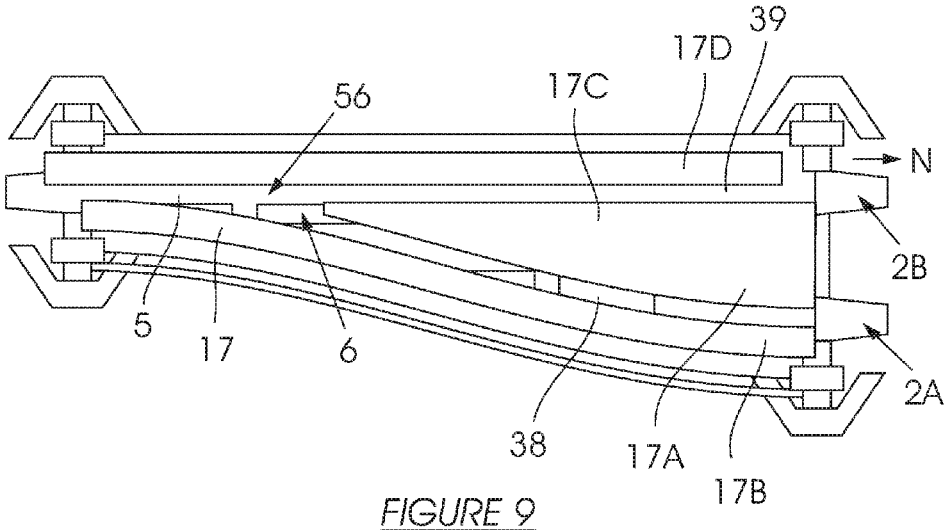
FIG. 9 is a plan view of the intersection of FIG. 8.

When the track (2) comes to a track intersection (6) as shown in FIGS. 8 and 9, the guidance means (37) is activated to force the bogie (2) into one of the two tracks (2A, 2B) leading from the intersection (6). As shown in FIGS. 8 and 9, leading up to the intersection (6) the track widens (56), and the elongate slot (5) spits into two, one slot (38, 39) leading into the centre of each of the two tracks (2A, 2B) leading from the intersection (6). Aligned with each slot (38, 39) is a guide member (40, 41) located above the track (2). Each guide member comprises a rib (40, 41) that includes a lead-in section.

In respect of the bogie (1), as shown in FIGS. 1 to 3, the guide means (37) comprises a frame (49) secured to the top of the bogie (1), above the driven wheel (9). Secured to the frame (49) is a first transverse bracket (50) which extends towards the sides of the bogie (1). Proximate each of the opposed ends of this transverse bracket (50) are secured rear guide wheels (51, 52).

The frame (49) further extends away from its connection point the bogie (1) longitudinally aligned with the bogie (1). At the forward end of frame (49) there is secured a second transverse bracket (53). Proximate each of the opposed ends of this second transverse bracket (53) are secured forward guide wheels (54, 55).

The forward and rearward guide wheels (51, 52, 54, and 55) are arranged that the forward and rearward guide wheels (51 and 54; 52 and 55) operate in concert. Each of the sets of guide wheels is axially movable between a lowered position and a raised position, with an intermediary neutral position.

In addition, the guide wheels (51 and 54; 52 and 55) are interconnected by a chain drive (not shown) secured to an electrical motor (not shown), to move them between the lowered and raised positions. The guide wheels (51 and 54; 52 and 55) are configured that if they are raised on one side, then the guide wheels on the opposing side are lowered. Both sets of guide wheels may be in the neutral position at the same time, but only one set of guide wheels (51 and 54; or 52 and 55) can be raised at any time.

In the raised position the guide wheels (51 and 54; 52 and 55) are aligned with the outside of the guide member rib (40, 41) on its side of the track (2). For example, if the bogie (1) needs to take the track (2A) leading to the right of a track intersection (6) then the right side's guide wheels (52, 55) are raised The guide wheels (52 55) will against the right side, i.e. the outside, of the guide rib (40) of the right track (2A).

The guide rib (40) follows the right track (2A) and the bogie (1) is thus forced to the right side of the track intersection (6). As mentioned above the driven wheel (9) is set of two driven wheels (9A, 9B), each of which is wider than the slot (5) extending along the track (2). The right driven wheel (9B) stays on the race (17B) on the right side of the track (2), and continues traveling along this.

The left driven wheel (9A) travels across the slot (38) that leads into the left track (2A) to follow to the right track (2B). Since the driven wheels (9A, 9B) are wider than the slots (5, 38, 39) the right side, i.e. the inside with respect to the bogie (1), of the left driven wheel (9A) engages the left race (17A) of the right track (2A) before the outside of the left driven wheel (9A) passes over the slot (5, 38), which is at the intersection (6), as shown in FIG. 9. The left driven wheel (9A) is thus always supported by the track (2).

With the left side guide wheels (51, 54) in the lowered position the left side guide rib (41) is not interacted with.

If the bogie (1) had to turn left the process would just be changed with right for left.

The guide means (37) may be controlled remotely from a central control room. Each bogie (1) includes a control system which is preloaded with directions. When it arrives at a specific track intersection (6) it receives from a track transponder a signal identifying the track intersection (6) which is then correlated to the planned route stored on the bogie control system (23). The bogie (1) then transmits a signal which is received by a receiver associated with one of the electromagnetic elements—essentially just a left or right signal. In the example above it would be a "right" signal.

In another configuration the bogie (1) has a unique identifier that announces its arrival at a track intersection (6), for example by way of a transponder. This will allow the control system to know when a specific bogie approaches a track intersection (6) which will then allow the control system to determine from a planned route into which direction the bogie (1) should be directed. A control signal is then transmitted to a track control system which activates the guide means (37).

When the bogie (1) has passed through the intersection (6) it awaits the next intersection identifier to determine further instructions to be sent.

A track intersection (6) is designed to include always one track that continues straight (2B), and one track (2A) that diverts from it, as shown in FIG. 9. This ensures that in the event the guide means (37) experiences a failure that the bogie continues driving on its original track, instead of crashing into the split between the two tracks (2A, 2B).

If the bogie (1) has to come to a halt or accelerate the remote control system or the on-board control system can similarly control the drive means to slow down or speed up. For this it will receive a signal from a transponder which is interpreted by the bogie control system (23) as a "stop", "change speed to X kph", or "accelerate to normal travel speed". There are many permutations of predetermined instructions that may be coded into a track transponder which provides passive instructions to each bogie passing it.

The bogie (1) will also be provided with a receiver which receives transponder signals from other bogies. This will allow the on-board control system (23) to bring a bogie (1) to a standstill before driving into another bogie, for example if bogies are waiting to be offloaded or in the event that a bogie (1) develop a mechanical problem on a track (2).

This control over the bogies may also be used to allow one or more bogies to line up behind another bogie and assist it, if for example the first bogie has a breakdown. Using this logic, and empty bogie may also be sent back to assist from the front of broken down bogie.

For this the bogies are fitted with couplings (not shown) to their front and rears allowing for such assisted movement. This may also be used pre-planned, where a load exceeds the drive capability of one bogie.

For such planned multi-bogie operations the load (7) may be supported between two bogies by being suspended between both their load support shafts (11). This allows two bogies to be driven optimally in terms of clamping force with the load (7) working equally onto both bogies.

The track does not only have to be elevated as shown in the drawings. The bogie (1) may also be used on a track located on the ground. The load support shaft will still extend below the pinch wheels (12, 13) but the load may be trailed behind the bogie on the track. The end of the load support shaft needs to extend below the pinch wheels to provide the predetermined ratio between the axis of the driven wheel and the attachment of the pinch wheel bracket to the load support shaft to the distance between the axis of the driven wheel and the load support bearing.

It should be appreciated that the track height need not be enormous to achieve clamping The distance between the attachment of the pinch wheel bracket and end of the load support shaft need not be enormous to achieve effective clamping and hence the bogie can operate with clearance as little as 100 mm to 250 mm under the track (i.e. below the second of the track surfaces). This allows the system to easily be installed on the ground.

It will be appreciated that the above described embodiment is given by way of example only and it not intended to limit the scope of the invention. It is possible to alter aspects thereof, as already indicated above in respect of the linear motor and ground based track, without departing from the essence of the invention.

It is for example also possible to drive the pinch wheels, alone or in combination with the load-bearing wheel.

It is also possible to pull a load behind the bogie, where it may run on wheels on the track. A load may also be pushed in front of the bogie. The bogie may be used thus essentially as a locomotive pulling or pushing one or more other bogies or freight cars.

It is also possible for the electrical rail to power, through the electrical contact, the motor directly and for the batteries to be dispensed with completely. This would be useful in applications where there is a consistent power supply to the track, and the bogie can then be operated without batteries which reduce the weight of the bogie.

The invention claimed is:

1. A rail transport bogie configured to operate on a track having track surfaces on opposite sides thereof and a slot through the track extending along substantially the centre of the track, the rail transport bogie comprising:

a load-bearing wheel to run on a first of the track surfaces;

a support shaft extending from the load-bearing wheel operatively through the slot in the track and terminating in load support means;

a pinch wheel bracket secured to the load support shaft, with the bracket extending to two opposing ends, a first end to a forward position in respect of the support shaft and second end to a rearward position in respect of the support shaft;

a forward pinch wheel rotatably secured to the first end of the pinch wheel bracket and a rearward pinch wheel rotatably secured to the second end of the pinch wheel bracket;

with both the forward and rearward pinch wheels located between the load-bearing wheel and load support means to run on the second of the two track surfaces, the load-bearing wheel and either the forward pinch wheel or rearward pinch wheel clamping between them the bogie to the opposing track surfaces;

with the ratio of:

the distance between the axis of the rearward pinch wheel and the attachment of the pinch wheel bracket to the load support shaft, to the distance between the attachment of the pinch wheel bracket to the load support shaft and the load support means, being variable depending upon how much friction is required between the driven wheels and the track surfaces to create the optimum amount of traction that is required for any specific set of circumstances;

and at least one of the load-bearing wheel and either or both of the pinch wheels connected to a motor operatively to be driven thereby to comprise a driven wheel for the bogie.

2. The rail transport bogie as claimed in claim 1 in which movement of the bogie in a forward or rearward direction is effected by forward or rearward driving of the driven wheel.

3. The rail transport bogie as claimed in claim 2 configured, upon acceleration thereof as a result of rotation of the driven wheel, for inertia of a load operatively secured to the load support means to pivot the bogie on the axis of the load-bearing wheel to force the pinch wheel located in the then rearward position relative to the direction of movement of the bogie against the second of the track surfaces, operatively increasing the clamping force between the load-bearing wheel and the rearward pinch wheel to increase friction between the load-bearing wheel and first of the two track surfaces to assist with acceleration of the bogie and the load secured to it.

4. The rail transport bogie as claimed in claim 3 configured, upon deceleration thereof as a result of braking of any of the wheels of the bogie, for inertia of a load operatively secured to the load support means to pivot the bogie on the axis of the load-bearing wheel to force the pinch wheel located in the then forward position relative to the direction of movement of the bogie against the second of the track surfaces, operatively increasing the clamping force between the load-bearing wheel and the forward pinch wheel to increase friction between the load-bearing wheel and first of the two track surfaces to assist with deceleration of the bogie and load secured to it, either to reduce its speed or bring it to rest.

5. The rail transport bogie as claimed in claim 4 configured, upon reaching a steady speed at which the force required to maintain the forward speed of the bogie is lower than the force required to accelerate the bogie from rest, for the rearward pinch wheel to be forced with a lesser force, or not to be forced at all, against the second of the track surfaces and respectively for the clamping force to be commensurately lower compared to when the bogie is accelerated from rest or for the clamping force to be zero, operatively allowing the bogie to move with a lower clamping force between the load-bearing wheel and the then rearward pinch wheel at steady speed than at acceleration of the bogie.

6. The rail transport bogie as claimed in claim 1 in which the driven wheel comprises a set of two axially aligned driven wheels, with the driven wheels configured such that they both run on either the first or the second of the two track surfaces on opposing sides of the slot in the track, and the two driven wheels are preferably axially connected.

7. The rail transport bogie as claimed in claim 1 in which each pinch wheel comprises a set of two axially aligned pinch wheels, with each pinch wheel set configured such that in each set the two pinch wheels run on the second of the two track surfaces on opposing sides of the slot in the track, and preferably with the two pinch wheels of each pinch wheel set being axially connected.

8. The rail transport bogie as claimed in claim 1 in which the load-bearing wheel comprises the driven wheel.

9. The rail transport bogie as claimed in claim 1 in which the bogie is predominantly operated horizontally, and the ratio of the distance between the axis of the rearward pinch wheel and the attachment of the pinch wheel bracket to the load support shaft to the distance between the attachment of the pinch wheel bracket and the load support means is between 1:2 and 1:5, and the ratio is preferably about 1:3.

10. The rail transport bogie as claimed in claim 1 in which the bogie is operated, at least on part of a track, at steep angles, and the ratio of the distance between the axis of the rearward pinch wheel and the attachment of the pinch wheel bracket to the load support shaft to the distance between the attachment of the pinch wheel bracket and the load support means is at least 1:5.

11. The rail transport bogie as claimed in claim 10 in which load-bearing wheel and the pinch wheels have resiliently compressible running surfaces, preferably comprised of rubber or plastics material, alternatively the load-bearing wheel and the pinch wheels have substantially incompressible running surfaces, preferably comprised of metal, further preferably steel.

12. The rail transport bogie as claimed in claim 1 in which the motor comprises a linear motor or a rotary motor, and a linear motor reaction plate or reaction plates forming part of the linear motor is secured to the load support shaft, preferably above the pinch wheel bracket, alternatively a rotary motor secured to the load support shaft, preferably below the pinch wheels.

13. The rail transport bogie as claimed in claim 12 which includes drive control means secured to the load support shaft proximate the motor, preferably on an opposing side of the load support shaft relative to the motor.

14. The rail transport bogie as claimed in claim 13 in which the motor and the driven wheel are rotatably secured by means of a drive belt or a drive shaft, and the drive belt preferably comprises a chain extending around sprockets on each of a drive shaft motor and the axis of the driven wheel.

15. The rail transport bogie as claimed in claim 1 which includes guidance means operable at each track intersection to move the bogie laterally across the track towards one side of the track or another, depending on which track the bogie is to follow leading from the track intersection, the guidance means comprising at least one guide wheel being movable between a neutral position and a guiding position, with the guide wheel configured in its guiding position to interact with a guide member that extends along a track leading from a track intersection to cause the bogie to follow such track, and the guide wheel configured to not interact with any guide member when it is located in its neutral position.

16. The rail transport bogie as claimed in claim 1 which includes guidance means operable at each track intersection to move the bogie laterally across the track towards one side of the track or another, depending on which track the bogie is to follow leading from the track intersection, the guidance means comprising at least two guide wheels located on opposing sides of a longitudinal axis of the bogie and being movable between a neutral position and a guiding position, with each guide wheel configured in its guiding position to interact with a guide member on its side of the longitudinal axis of the bogie that extends along a track leading from a track intersection to cause the bogie to follow such track, and the guide wheels configured to not interact with any guide member when they are located in their neutral positions.

17. The rail transport bogie as claimed in claim 16 in which the two guide wheels are connected and configured such that both guide wheels cannot simultaneously be in their respective guiding positions, and preferably includes an electrical contact configured complimentary to an electrical rail associated with the track operatively to electrically connect the bogie with the rail.

18. The rail transport bogie as claimed in claim 17 in which the electrical contact extends from above and to the side of the driven wheel, and the contact is preferably electrically connected and configured to charge the battery or power the motor.

19. The rail transport bogie as claimed in claim 1 in which the motor is connected to the driven wheel via a sprocket secured to a secondary axis proximate the axis of the driven wheel, with the secondary axis and the axis of the driven wheel being rotatably secured to each other by meshed gears having a predetermined gear ratio, and the drive shaft preferably comprises a secondary drive shaft connected from the motor drive shaft to the axis of the driven wheel using a coupling, preferably a differential coupling.

20. The rail transport bogie as claimed in claim 1 in which the load support means comprises a load bearing secured to the end of the load support shaft, and the load may preferably be secured to the load support means enabling the load to be suspended from the bogie, pulled behind the bogie or pushed in front of the bogie.

21. The rail transport bogie as claimed in claim 1 which includes a frame secured proximate the load support shaft end, the frame extending to two opposing ends, a first end to a forward position in respect of the support shaft and second end to a rearward position in respect of the support shaft, and each end extends into an arm directed towards the pinch wheel on its side of the load support shaft, with each arm carrying a battery.

22. The rail transport bogie as claimed in claim 21 in which each arm terminates in at least one directional control wheel operatively running on the sides of the slot in the track, and each arm terminates in a set of spaced apart directional control wheels operatively running on opposing sides of the slot in the track, the running surfaces of the directional control wheels spaced apart by a distance complimentary to the width of the slot.

23. A rail transportation system comprising a network of tracks, a plurality of bogies as claimed in claim 1 each of which has a driven wheel arranged to run on and be supported by the track and which are capable of supporting, pulling or pushing a load secured to the bogie, each bogie being driven along the track and including guidance means which allows it to switch from a track leading to a track intersection to a preselected track leaving the track intersection without any load-bearing wheel of the bogie being unsupported by the track.

24. The rail transportation system as claimed in claim 23 in which the track intersection includes no moving parts to enable bogie switching, and the track preferably comprises an elongate set of races spaced apart by an elongate slot with the set of races kept in spatial relation to each other by means of a frame extending from the sides of the races.

25. A track for the rail transportation system as claimed in claim 24 that is modular and the modules include straight sections and curved sections, and each module comprises a set of races spaced apart by an elongate slot through the track operatively allowing the support shaft of a bogie to extend through the slot, with the set of races kept in spatial relation to each other by means of a frame extending across the track, and with each race being provided with a wear resistant lining removably secured to its top, bottom and its side facing the slot.

26. The track as claimed in claim 25 in which the frame includes a brace proximate the end of each module with each brace having a set of spaced apart legs, each of which is secured to a side of the track, with covers secured between the braces to enclose at least part of the track, and with braces of adjoining modules substantially sealing against each other, and each end brace of a module preferably includes a flange securable to a complimentary flange of an end brace of an adjoining module, operatively allowing modules to be secured end to end, and the race of the track is further preferably comprised of an elongate beam, more preferably a hollow beam, and still further preferably a hollow steel beam.

* * * * *